United States Patent [19]

Hellwig et al.

[11] Patent Number: 4,485,326

[45] Date of Patent: Nov. 27, 1984

[54] ELECTRIC LAMP WITH A SLEEVE-SHAPED CAP

[75] Inventors: Paul Hellwig; Werner Schlagheck, both of Aachen, Fed. Rep. of Germany

[73] Assignee: U.S. Philips Corporation, New York, N.Y.

[21] Appl. No.: 598,398

[22] Filed: Apr. 10, 1984

Related U.S. Application Data

[63] Continuation of Ser. No. 189,488, Sep. 22, 1980, abandoned.

[30] Foreign Application Priority Data

Oct. 10, 1979 [DE] Fed. Rep. of Germany ..... 2941011

[51] Int. Cl.[3] ..... H01J 5/48

[52] U.S. Cl. ..... 313/318; 313/325

[58] Field of Search ..... 313/318

[56] References Cited

U.S. PATENT DOCUMENTS

| | | | |
|---|---|---|---|
| 1,262,936 | 4/1918 | Fowler | 313/318 |
| 3,631,379 | 12/1971 | Willoughby et al. | 313/318 |
| 3,898,506 | 8/1975 | Willoughby et al. | 313/318 |
| 4,384,236 | 5/1983 | Hellwig et al. | 313/318 |

*Primary Examiner*—Harold Dixon

*Attorney, Agent, or Firm*—Robert S. Smith

[57] ABSTRACT

In an electric lamp, the lamp bulb has a flat pinch, on the minor faces of which there are recesses into which projections on the cap are locked. The lamp bulb is thus secured against rotation and translation in the cap, and the power leads are not under mechanical stress.

7 Claims, 8 Drawing Figures

ELECTRIC LAMP WITH A SLEEVE-SHAPED CAP

This is a continuation of application Ser. No. 189,488 filed Sept. 22, 1980, now abandoned.

The invention relates to an electric lamp with a glass bulb having a flat pinch with two opposing major faces, two opposing minor faces, and an end face from which power leads protrude. The lead runs through the pinch to an electrical element inside the bulb, the pinch being situated inside a sleeve-shaped cap and fixed between inwardly-directed projections in the cap.

A lamp of this type is known from German Offenlegungsschrift No. 1,980,641 in which the cap has two pairs of projections opposite each other, which are formed by making local indentations in the cap. One projection of each pair is respectively adjacent to a respective major face of the pinch. The bulb is thus secured against rotation in relation to the cap. The bulb is fixed to the cap by tightening the power leads and fastening them to the cap. The power leads are thus under mechanical load. If they are not sufficiently strong, or if they are not fixed firmly enough to the cap, then the fastening of the cap to the bulb will not be sufficiently reliable.

The invention aims at a reliable fastening of the bulb to the cap, in which the power leads are not under mechanical stress.

In lamps of the type described in the opening paragraph, this aim is achieved according to the invention in that the said faces of the pinch each have at least one recess, into each of which a respective cap projection locks.

The projections which fit into the recesses prevent not only rotation, but also axial movement of the bulb in the cap.

In one embodiment, at least one of the minor faces of the pinch has bevelled edges where it joins the major faces, said recesses being provided in said edges. This design is advantageous in the case of lamps with very thin pinches.

Preferably, the peripheral edge of the cap abuts the lamp bulb. The cap and bulb thus form a particularly sturdy unit. In this event the recesses may extend some way past the projections in the direction of the bulb.

The assembly of cap and bulb is facilitated in an embodiment of the lamp in which the major faces of the pinch become narrower towards the end face of the pinch. This is particularly important when the cap is not pliable enough to allow easy assembly. In that case, however, it is alternatively possible to form the projections in the cap after the bulb and cap have been put together, or to enlarge them by indenting the cap further.

As an alternative to projections formed by indentations in the cap, inwardly-protruding pins attached to the cap can be used.

The mounting of a bulb to a cap by means of the cooperating recesses and projections is particularly suitable for application in halogen incandescent lamps with a bulb made of hard glass or quartz glass, and in particular for miniature lamps. Lamps of this type may be used as car lamps, for example.

Embodiments of lamps according to the invention will now be described with reference to the accompanying drawings, of which:

Figure 1:
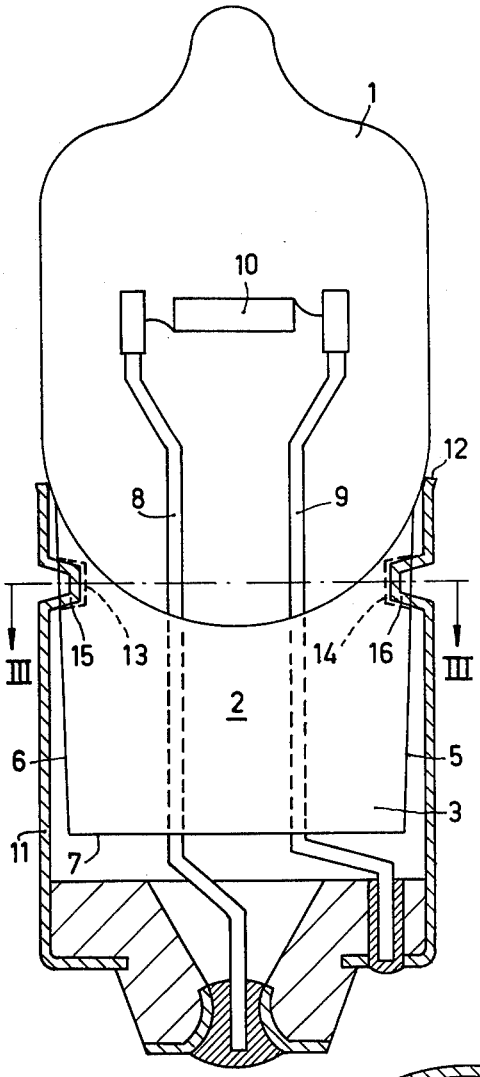
FIG. 1 shows a first embodiment of a lamp with the bulb in elevation and with the cap in cross-section.
Figure 2:
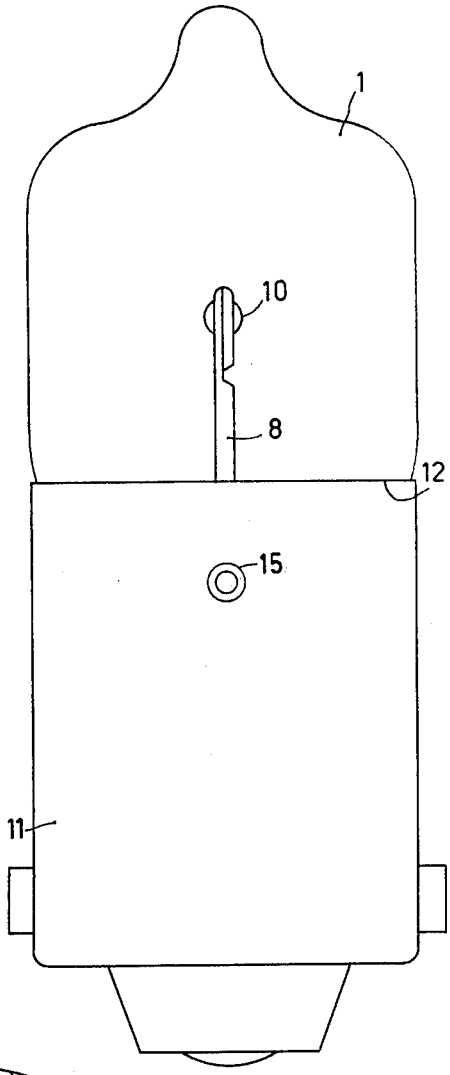
FIG. 2 shows the lamp of FIG. 1 in elevation, turned through 90° on its axis.
Figure 3:
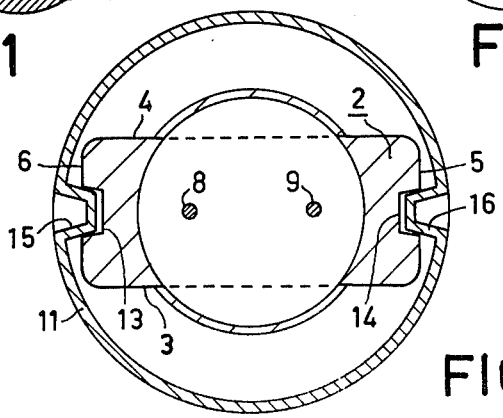
FIG. 3 shows a cross-section along the line III—III in FIG. 1.

The lamps in FIGS. 1, 2 and 3 has a hard-glass bulb 1 with a pinch 2, which has two opposing major faces 3 and 4, two opposing minor faces 5 and 6, and an end face 7.

Power leads 8 and 9 run from a filament 10 through the pinch 2 and protrude from the end face 7 of the pinch 2.

The pinch 2 is situated in a sleeve-shaped cap 11, the peripheral edge 12 of which abuts the bulb 1. In the minor faces 5 and 6 of the pinch 2 there are recesses 13 and 14, into which projections 15 and 16 respectively, which protrude inwards from the cap 11, lock.

The major faces 3 and 4 of the pinch 2 become narrower towards the end face 7. The assembly of bulb 1 and cap 11 is thus facilitated.

Figure 4:
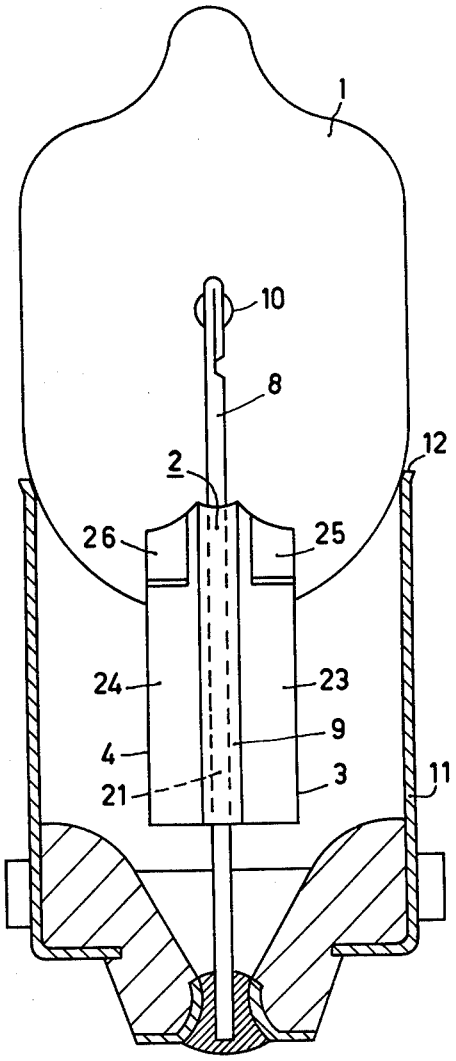
FIG. 4 shows a second embodiment of a lamp with the bulb in elevation and the cap in cross-section.
Figure 5:
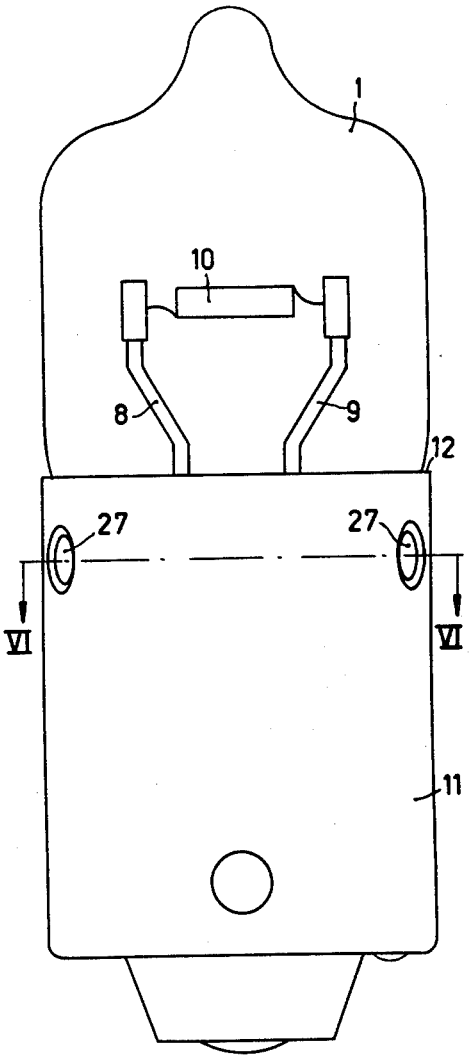
FIG. 5 shows the lamp of FIG. 4 in elevation, turned through 90° on its axis.
Figure 6:
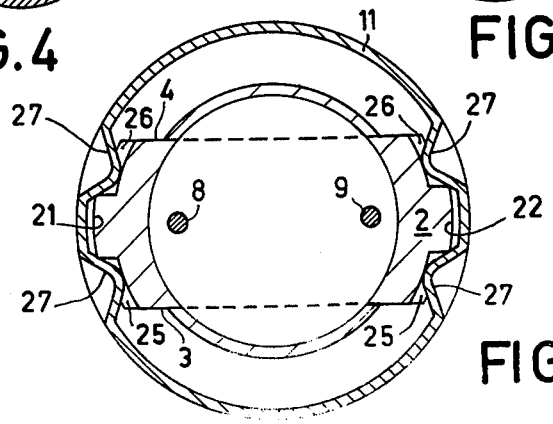
FIG. 6 shows a cross-section along the line VI—VI in FIG. 5.

In FIGS. 4, 5 and 6, parts corresponding to parts in the previous Figures are given the same reference numbers.

The minor faces 21 and 22 of the pinch 2 have bevelled edges 23, 24 where they join the minor faces 3 and 4, in which edges there are recesses 25 and 26 respectively in which projections 27 of the cap 11 fit. Since the case of this lamp, too, the peripheral edge 12 of the cap 11 abuts the bulb 1, the recesses 25 and 26 can extend above the projections 27 in the direction of the bulb without this affecting the fixed position of the bulb 1 in relation to the cap 11.

Figure 7:
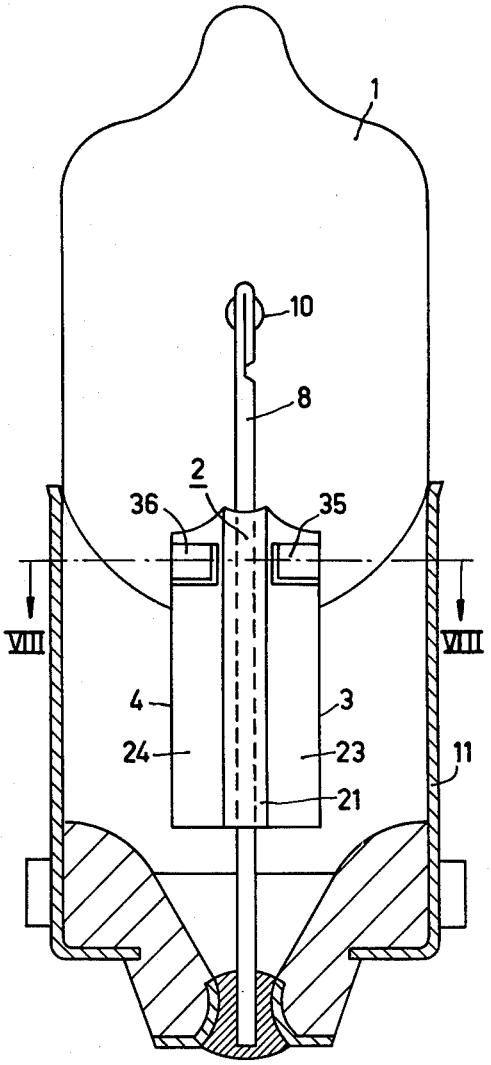
FIG. 7 shows a third embodiment of a lamp with the bulb in elevation and the cap in cross-section.
Figure 8:
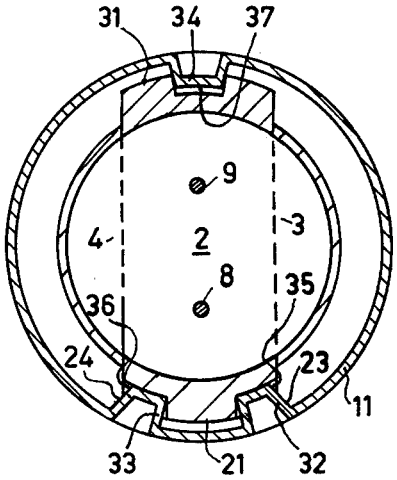
FIG. 8 shows a cross-section along the line VIII—VIII in FIG. 7.

The lamp in FIGS. 7 and 8 has a pinch 2 with two major faces 3 and 4 and two minor faces 21 and 31, of which face 21 has bevelled edges 23 and 24 in which recesses 35 and 36 are respectively situated. The minor face 31 has a recess 37. The projections 32, 33 and 34 of the cap 11 fit into the recesses 23, 24, and 37 respectively and secure the bulb 1 in the cap 11 against both axial movement and rotation. The bulb 1 has an outer diameter smaller than the inside diameter of the cap 11.

Since in each case the bulb is securely fastened to the cap by means of the cooperating recesses and projections, there is no need to stretch the power leads prior to their connection to the cap in order to achieve this purpose. Thus the lamp is more reliable in operation than one with stretched leads.

What is claimed is:

1. An electric lamp having a glass bulb, a unitary sleeve shaped cap and integral means for preventing relative radial and axial movement of said cap with respect to said bulb, said means consisting of said sleeve shaped cap having inwardly-directed projections and said glass bulb having a flat pinch with two opposing major faces, two opposing minor faces, and an end face from which power leads protrude, said leads extending through said pinch to an electrical element inside said lamp bulb, said pinch being situtated inside said sleeve-shaped cap and fixed between said inwardly-directed projections in the cap, said minor faces of said pinch each have at least one recess dimensioned and configured for locking engagement with respective inwardly-directed projections.

2. An electric lamp as claimed in claim 1, characterized in that a peripheral edge of the sleeve-shaped cap abuts the bulb.

3. An electric lamp as claimed in claim 1, characterized in that the major faces of the pinch become narrower towards the end face of the pinch.

4. The electric lamp having a glass bulb, a sleeve shaped cap and means for preventing relative radial and axial movement of said cap with respect to said bulb, said means consisting of said sleeve shaped cap having inwardly-directed projections and said glass bulb having a flat pinch with two opposing major faces, two opposing minor faces, and an end face from which power leads protrude, said leads extending through said pinch to an electrical element inside said lamp bulb, said pinch being situtated inside said sleeve-shaped cap and fixed between said inwardly-directed projections in the cap, said minor faces of said pinch each have at least one recess dimensioned and configured for locking engagement with respective inwardly-directed projections, at least one of the minor faces of the pinch having bevelled edges where it joints the major faces, said recesses being provided in said edges.

5. An electric lamp having a glass bulb, a sleeve shaped cap and means for preventing relative radial and axial movement of said cap with respect to said bulb, said means consisting of said sleeve shaped cap having inwardly-directed projections and said glass bulb having a flat pinch with two opposing major faces, two opposing minor faces, and an end face from which power leads protrude, said lead extending through said pinch to an electrical element inside said lamp bulb, said pinch being situated inside said sleeve-shaped cap and fixed between said inwardly-directed projections in the cap, said minor faces of said pinch each have at least one recess dimensioned and configured for locking engagement with respective inwardly-directed projections, a peripheral edge of the sleeve-shaped cap abuts the bulb.

6. An electric lamp having a glass bulb, a sleeve shaped cap and means for preventing relative radial and axial movement of said cap with respect to said bulb, said means consisting of said sleeve shaped cap having inwardly-directed projections and said glass bulb having a flat pinch with two opposing major faces, two opposing minor faces, and an end face from which power leads protrude, said leads extending through said pinch to an electrical element inside said lamp bulb, said pinch being situtated inside said sleeve-shaped cap and fixed between said inwardly-directed projections in the cap, said minor faces of said pinch each have at least one recess dimensioned and configured for locking engagement with respective inwardly-directed projections, the major faces of the pinch being narrower towards the end face of the pinch.

7. An electric lamp having a glass bulb, a sleeve shaped cap and means for preventing relative radial and axial movement of said cap with respect to said bulb, said means consisting of said sleeve cap having inwardly-directed projections and said glass bulb having a flat pinch with two opposing major faces, two opposing minor faces, and an end face from which power leads protrude, said leads extending through said pinch to an electrical element inside said lamp bulb, said pinch being situated inside said sleeve-shaped cap and fixed between said inwardly-directed projections in the cap, said minor faces of said pinch each have at least one recess dimensioned and configured for locking engagement with respective inwardly-directed projections, a peripheral edge of the sleeve-shaped cap abuts the bulb, the major faces of the pinch being narrower towards the end face of the pinch.

* * * * *